US009108291B2

(12) United States Patent
Lakrout

(10) Patent No.: US 9,108,291 B2
(45) **Date of Patent: *Aug. 18, 2015**

(54) METHOD OF FORMING STRUCTURED-OPEN-NETWORK POLISHING PADS

(75) Inventor: Hamed Lakrout, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 226 days.

This patent is subject to a terminal disclaimer.

(21) Appl. No.: 13/240,072

(22) Filed: Sep. 22, 2011

(65) Prior Publication Data

US 2013/0074419 A1 Mar. 28, 2013

(51) Int. Cl.

| | |
|---|---|
| ***B24D 11/00*** | (2006.01) |
| ***B24B 37/22*** | (2012.01) |
| ***B24B 37/26*** | (2012.01) |
| ***B24D 18/00*** | (2006.01) |

(52) U.S. Cl.

CPC ..... *B24B 37/22* (2013.01); *B24B 37/26* (2013.01); *B24D 18/00* (2013.01)

(58) Field of Classification Search

None

See application file for complete search history.

(56) References Cited

U.S. PATENT DOCUMENTS

| | | | | |
|---|---|---|---|---|
| 5,322,986 | A * | 6/1994 | Nutt | 219/121.6 |
| 5,474,719 | A | 12/1995 | Fan et al. | |
| 5,554,336 | A | 9/1996 | Hull | |
| 5,965,460 | A | 10/1999 | Rach et al. | |
| 6,036,579 | A | 3/2000 | Cook et al. | |
| 6,210,254 | B1 | 4/2001 | Cook et al. | |
| 6,217,432 | B1 | 4/2001 | Woo | |
| 6,413,403 | B1 * | 7/2002 | Lindquist et al. | 205/97 |
| 6,807,705 | B2 * | 10/2004 | Piombini | 15/230.1 |
| 7,503,833 | B2 | 3/2009 | Muldowney | |
| 7,517,277 | B2 | 4/2009 | Muldowney | |
| 7,530,887 | B2 | 5/2009 | Jiang et al. | |
| 7,604,529 | B2 | 10/2009 | Muldowney | |
| 7,635,290 | B2 | 12/2009 | Muldowney | |
| 7,828,634 | B2 | 11/2010 | Jiang et al. | |
| 8,801,949 | B2 * | 8/2014 | Lakrout et al. | 216/48 |
| 8,894,799 | B2 * | 11/2014 | Lakrout | 156/272.2 |
| 2004/0042937 | A1 * | 3/2004 | Bentsen et al. | 422/129 |
| 2004/0111817 | A1 * | 6/2004 | Chen et al. | 15/104.94 |
| 2004/0115431 | A1 * | 6/2004 | Chen et al. | 428/373 |

(Continued)

OTHER PUBLICATIONS

Copending U.S. Appl. No. 13/240,007.

(Continued)

*Primary Examiner* — Kaj K Olsen
*Assistant Examiner* — Ross J Christie
(74) *Attorney, Agent, or Firm* — Blake T. Biederman

(57) ABSTRACT

The invention is a method of forming a layered-open-network polishing pad useful for polishing at least one of magnetic, semiconductor and optical substrates. Exposing a first and second polymer sheet or film of a photocurable polymer creates an exposure pattern in the first and second polymer sheet. The exposure pattern has elongated sections exposed to the energy source. The light exposure is of an exposure time sufficient to cure the photocurable polymer, but insufficient to cure adjacent elongated sections together. Attaching the first and second polymer sheets forms a polishing pad with the patterns of the first and second polymer sheets crossing. Curing the layered-open-network polishing pad to secure the layered-open-network polishing pad with the first and second sheets having sufficient stiffness to reduce sagging and maintain an orthogonal relationship between the elongated channels and the parallel planes of the polymer sheets.

10 Claims, 6 Drawing Sheets

(56) References Cited

U.S. PATENT DOCUMENTS

| | | | | |
|---|---|---|---|---|
| 2004/0259479 | A1 | 12/2004 | Sevilla | |
| 2005/0129897 | A1* | 6/2005 | Zhou et al. | 428/43 |
| 2005/0130536 | A1* | 6/2005 | Siebers et al. | 442/327 |
| 2006/0052040 | A1* | 3/2006 | Prasad | 451/41 |
| 2006/0135026 | A1* | 6/2006 | Arendt et al. | 442/400 |
| 2006/0148393 | A1 | 7/2006 | Ono et al. | |
| 2008/0057845 | A1* | 3/2008 | Prasad | 451/530 |
| 2009/0047877 | A1* | 2/2009 | Muldowney | 451/59 |

OTHER PUBLICATIONS

Copending U.S. Appl. No. 13/239,951.

* cited by examiner

METHOD OF FORMING STRUCTURED-OPEN-NETWORK POLISHING PADS

BACKGROUND OF THE INVENTION

The present invention relates to polishing pads for chemical mechanical polishing (CMP). In particular relates to methods of forming open-network polishing pads useful for polishing magnetic, optical or semiconductor substrates.

Multi-layer semiconductor wafers having integrated circuits fabricated thereon must be polished to provide a smooth and flat wafer surface. This polishing is necessary to provide a flat surface for subsequent layers and prevent the exaggerated structural distortions that would occur in the absence of polishing. Semiconductor manufacturers accomplish this through multiple CMP operations where a chemical active slurry or abrasive-free polishing solution interacts with a rotating polishing pad to smooth or planarize a wafer's surface.

The single greatest problem associated with the CMP operation is often wafer scratching. Certain polishing pads can interact with foreign materials that result in gouging or scratching of the wafer. For example, this interaction with foreign material can result in chatter marks in hard materials such as, TEOS dielectrics. For purposes of this specification, TEOS represents the hard glass-like dielectric formed from the decomposition of tetraethyloxysilicates. This damage to the dielectric can result in wafer defects and lower wafer yield. Another scratching issue associated with CMP operations is the damaging of nonferrous interconnects, such as copper interconnects. If the pad scratches too deep into the interconnect line, the resistance of the line increases to a point where the semiconductor will not function properly. In extreme cases, polishing creates mega-scratches that can result in the scrapping of an entire wafer.

Although all stiff pads do not have high wafer scratching rates, scratching tends to increase with a polishing pad's stiffness or modulus. Over the years, polishing pad manufacturers have traveled multiple avenues in search of soft pads with low defectivity rates. These attempts have focused on composition and manufacturing technique to improve defectivity. Although pad manufacturers continue to improve defectivity, industry demands for low defectivity continue to outstrip the state-of-the-art polishing pads. Cook et al. in U.S. Pat. No. 6,036,579, describe a photocuring process for making soft pads. This process applied a liquid photocurable polymer to a solid polymer sheet and exposed the photocurable polymer to light for curing or crosslinking selected land areas as defined through a photomask or in a direct pattern. Direct patterns include for example, direct laser UV light, such as computer to screen technologies. After exposing the pad through a photomask or direct pattern, water washed away the unexposed polymer to form grooves. Although these pads contained solid polymer base layers that facilitate planarization, the pads lacked the compressibility necessary for reducing defects in the most demanding applications. Furthermore, these pads failed to provide sufficient polishing uniformity for demanding CMP applications. In particular, the pads were subject to premature failure due to water absorption that resulted in polishing pads having severe dimensional instability.

Another avenue for decreasing defectivity is to vary a polishing pad's physical properties. For example, increasing a polishing pad's surface asperities that interact with the substrate surface or contact area can lower defects. Increasing the contact area lowers defects by lowering the average polishing downforce on the substrate surface. Although this sounds simple in principle, it often remains a difficult objective. For example it is possible to manufacture pads with a combination of polymeric microspheres and coagulated polyurethane to achieve an optimum balance of surface area with sufficient texture as to not jeopardize polishing rate. Alternatively, woven structures can have large surface interactions with substrates surfaces, but these structures often lack a consistent cross-section for uniform polishing.

In addition to low defectivity, the polishing pad must also have thermal stability for consistent polishing performance with minor temperature shifts. Typically, polishing pads become softer with increased temperatures. But the softening of the pad often results in lowered removal rates. Thus, the polishing pad's physical properties should show minimal temperature related deterioration.

There is an ongoing industry desire for polishing pads that provide an improved combination of planarization, removal rate and defectivity. In addition, there remains a demand for a polishing pad that provides these properties in a polishing pad with ultra-low defectivity. Finally, there remains a demand for soft texture-containing polishing pads that have the dimensional stability to survive in demanding polishing conditions without an undue deterioration in polishing properties.

STATEMENT OF THE INVENTION

The invention provides a method of forming a layered-open-network polishing pad useful for polishing at least one of magnetic, semiconductor and optical substrates comprising: a) providing a first and second polymer sheet or film of a photocurable polymer, the first and second polymer sheet or film having a thickness; b) exposing the first and second polymer sheets to an energy source to create an exposure pattern in the first and second polymer sheet, the exposure pattern having elongated sections exposed to the energy source, the light exposure being of an exposure time sufficient to cure the photocurable polymer, the exposure time being insufficient to cure adjacent elongated sections together; c) removing polymer from the exposed first and second polymer sheets to form elongated channels through the first and second polymer sheets in a channel pattern that corresponds to the exposure pattern, the elongated channels extending through the thickness of the first and second polymer; d) attaching the first and second polymer sheets to form a polishing pad, the patterns of the first and second polymer sheets crossing wherein the first polymer sheet supports the second polymer sheet and the elongated channels from the first and second polymer sheets connect in parallel planes to form the layered-open-network polishing pad with one of the polymer sheets forming a polishing surface; and e) curing the layered-open-network polishing pad to secure the layered-open-network polishing pad with the first and second sheets having sufficient stiffness to reduce sagging and maintain an orthogonal relationship between the elongated channels and the parallel planes of the polymer sheets.

An alternative embodiment of the invention provides a method of forming a layered-open-network polishing pad useful for polishing at least one of magnetic, semiconductor and optical substrates comprising: a) providing a first and second polymer sheet or film of a photocurable polymer, the first and second polymer sheet or film having a thickness; b) exposing the first and second polymer sheets to an energy source to create an exposure pattern in the first and second polymer sheet, the exposure pattern having elongated sections exposed to the energy source, the light exposure being of an exposure time sufficient to cross-link the photocurable polymer, the exposure time being insufficient to cross-link adjacent elongated sections together; c) removing polymer from the exposed first and second polymer sheets with an aqueous solution to form elongated channels through the first and second polymer sheets in a channel pattern that corresponds to the exposure pattern, the elongated channels extending through the thickness of the first and second polymer; d) drying the first and second sheets to remove the aqueous solution and provide a partial cure for the first and second sheets; e) attaching the first and second polymer sheets to form a polishing pad, the patterns of the first and second polymer sheets crossing wherein the first polymer sheet supports the second polymer sheet and the elongated channels from the first and second polymer sheets connect in parallel planes to form the layered-open-network polishing pad with one of the polymer sheets forming a polishing surface; and f) curing the layered-open-network polishing pad to secure the layered-open-network polishing pad with the first and second sheets having sufficient stiffness to reduce sagging and maintain an orthogonal relationship between the elongated channels and the parallel planes of the polymer sheets, the orthogonal relationship being an angle between 80 and 100 degrees.

DETAILED DESCRIPTION OF THE INVENTION

Figure 1:
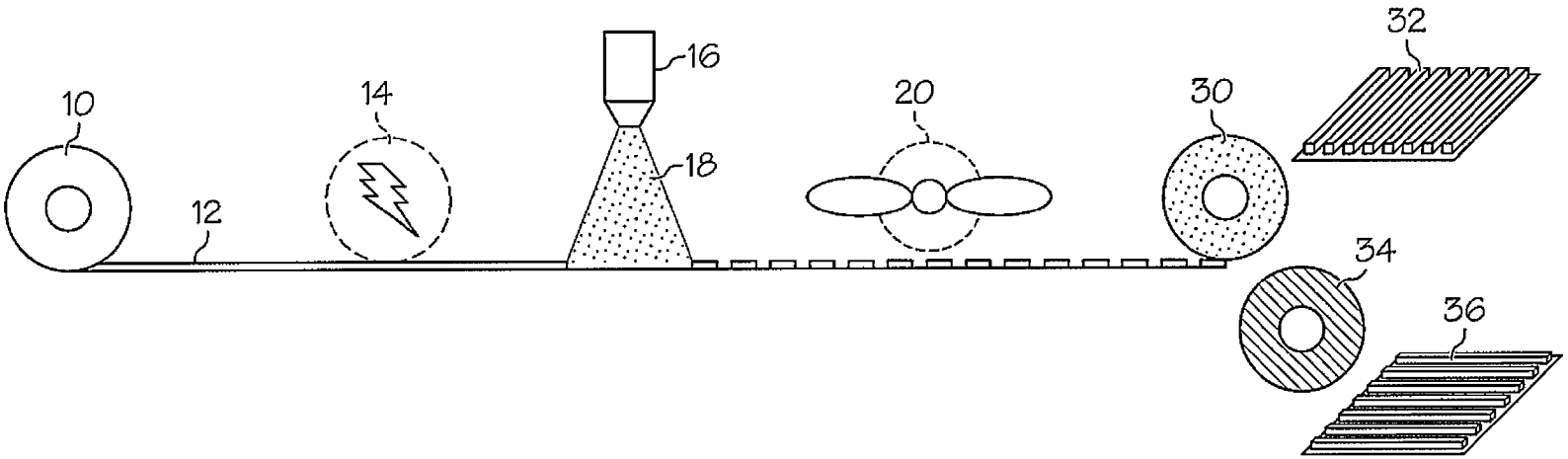
FIG. 1 is a schematic drawing that illustrates a continuous method for forming finished feed stock.

The invention provides a method of forming an open-network polishing pad useful for polishing at least one of magnetic, semiconductor and optical substrates. In particular, the invention uses a polymer sheet or film of a curable polymer. The method exposes the curable polymer to an energy source to create an exposure pattern. The exposure pattern includes elongated sections. Then the polymer sheet attaches to the open-network structure. The process removes polymer adjacent from the exposed polymer sheet or film of the intermediate structure with a solvent, such as water. The process either removes the backing layer of the polymer sheet or film after attaching the polymer sheet and sending solvent and polymer through the open-network substrate. Alternatively, the process removes the polymer with the backing layer attached to the polymer sheet with the solvent before attaching the polymer sheet or film to the open-network substrate. This forms elongated channels through the polymer sheet or film in a textured pattern that corresponds to the exposure pattern. This method allows the formation of a single polishing layer pad or stacking of two or more polymer sheets to form a multi-layer pad.

It is possible to secure the open-network structure by either securing polymer sheets first to form an intermediate layered sheet structure and then adding the intermediate structure to the porous substrate or to sequentially adding sheet layers to a porous substrate. In these embodiments, the porous substrate can provide the polishing pad with improved flexibility that facilitates the polishing of uneven wafers or difficult topography within wafers. When sequentially adding sheet layers to a porous substrate, the method includes exposing at least a first and a second polymer sheet or film each with a backing layer; attaching the first layer to the porous substrate; the second layer to the first layer and then removing the backing layer from the first sheet or film before attaching the second sheet or film to the first sheet or film. Removing the backing layer before adding subsequent layers allows the network to form open channels between multiple layers. For building larger open networks, removing the backing layer of the earlier-attached layer provides an open channel location for the polymer sheet or film. The final or top polymer sheet or film forms the polishing surface.

Optionally, it is possible to produce polishing pads without the use of a porous substrate. In this process, attaching the first and second polymer sheets after exposure forms a polishing pad. The patterns of the first and second polymer sheets cross with the first polymer sheet supporting the second polymer sheet. The elongated channels from the first and second polymer sheets also connect to form the layered-open-network polishing pad with the first layer forming a base layer for attachment to a polishing platen. The base layer can attach to the polishing layer by adhesive or most advantageously by two-sided pressure sensitive adhesive. This structure provides the advantage of having uniform physical properties from top to bottom and can improve pad stiffness and planarization.

In addition, the method includes either multiple solvent exposure and drying steps or one singular washing and drying steps. For fine channel or texture processes, it is advantageous to develop the layers in multiple steps. In this method, the solvent, such as water, removes the polymer with the backing layer attached to the polymer sheet before attaching the polymer sheet or film to the open-network substrate. Furthermore, it is advantageous to dry the polymer sheet or film before attaching the polymer sheet or film. This drying can also provide the benefit of partially curing the polymer sheet or film. With large channels, it is possible to develop the polymer in a single step with the solvent removing polymer through the porous substrate.

After developing, curing the layered-open-network polishing pad secures the layered-open-network polishing pad. When securing more than one polymer sheet or film, it is important that the first and second sheets have sufficient stiffness to reduce sagging. A partial curing of the polymer sheet or film can reduce sagging. Furthermore, it is important to form an orthogonal relationship between the elongated channels and the parallel planes of the polymer sheets. If the exposure is excessive, then the polymer sheet will bridge the channels. And if the exposure is insufficient, then the sheets will bend or sag between layers. When exposure and curing are proper, the layers form orthogonal structures. The orthogonal network structures have perpendicular channel side walls and horizontal top and bottom surfaces of the polymer sheets. Curing the layers at specific temperatures for a predermined time, such as 0.5 to 4 hours, locks in the mechanical properties. Because polishing can occur at temperatures in excess of 100° C., it advantageous to cure the polymer before use, rather than curing the pad during use.

The polymer sheet or film includes an energy-driven binder within a curable organic material (i.e., polymer subunits or materials capable of polymerizing or crosslinking by exposure to light, mechanical, heat or other sources of energy). Energy-driven binders include amino polymers or aminoplast polymers such as alkylated urea-formaldehyde polymers, melamine-formaldehyde polymers, and alkylated benzoguanamine-formaidehyde polymers; acrylates (both acrylates and methacrylates) such as alkyl acrylates, acrylated epoxies, acrylated urethanes, acrylated polyesters, acrylated polyethers, acrylated oils, and acrylated silicones; vinyl ether monomers or oligomers; vinyl alcohols, such as poly vinyl alcohol, alkyd polymers such as urethane alkyd polymers, polyester polymers, reactive urethane polymers, hydroxybutyrates, such as poly (3-hydroxybutyrate), phenolic polymers such as resole and novolac resins, phenolic/latex blends, epoxy polymers such as bisphenol epoxy resins, isocyanates, isocyanurates, polysiloxane polymers including alkylalkoxysilane polymers. The resulting polymer sheet or film may be in the form of monomers, oligomers, polymers, or combinations thereof. The aminoplast binder precursors have at least one pendant alpha, beta-unsaturated carbonyl group per molecule or oligomer. The hydrolytic and thermal stability of the polishing pad vary with material. For thermal stability, it is important to cure the pad before polishing. With respect to hydrolytic stability, a full cure in combination with the open-network structure limits the detrimental impact arising from dimensional changes. Similarly, the porous substrate can also accommodate some dimensional changes associates with extended water exposure.

The elongated channels extend through the thickness of the polymer sheet or film to form the open-network polishing pad. This network may contain one or more layers of curable polymer sheet or film. For fine textures, such as polishing layers having distance between features less than 100 microns, the network preferably contains two or more cured layers. For coarse textures, such as those having a distance between features greater than 100 microns, the network preferably contains a single cured layer on a base layer.

Figure 2:
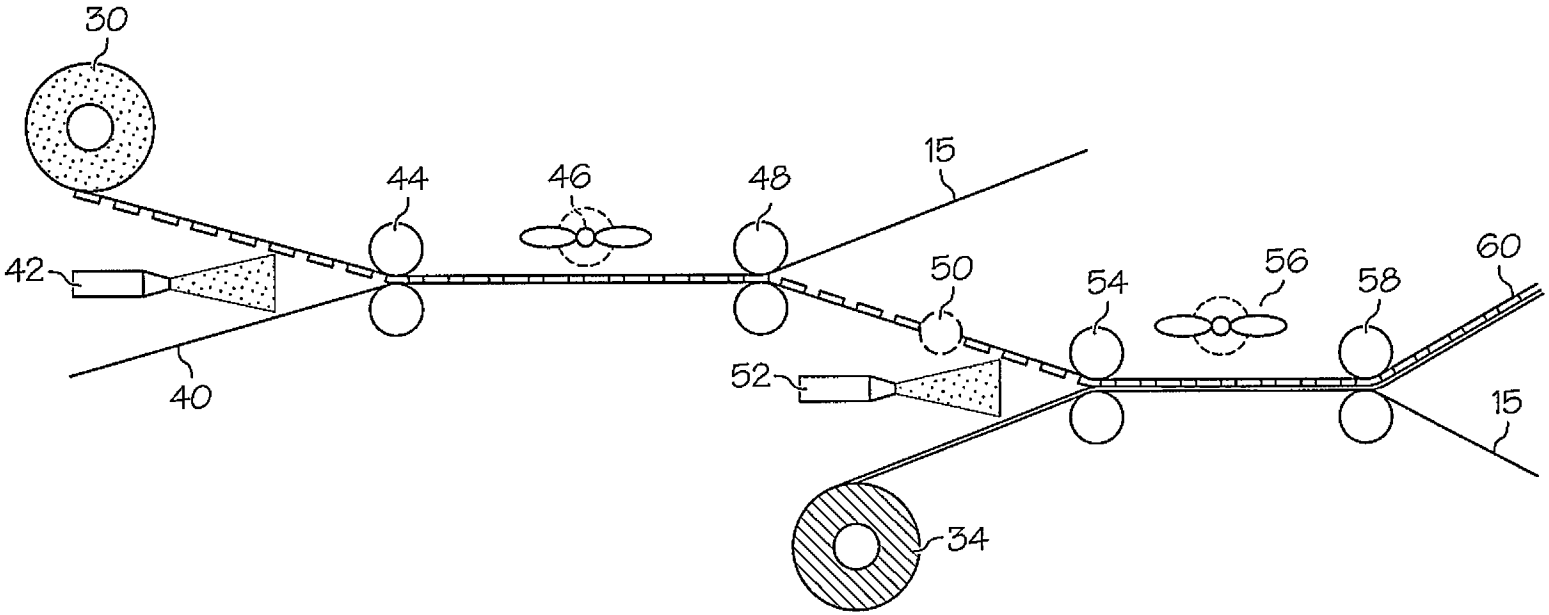
FIG. 2 is a schematic drawing that illustrates a continuous method for converting the finished feedstock into open network polishing pad material.

The method of the invention utilizes multiple steps that are suitable for both continuous, semi-continuous and batch processes. Preferably, the method operates in a continuous or semi-continuous roll-to-roll process. Referring to FIG. 1, a roll 10 of curable polymer sheet or film 12 consists of a curable material, such as a photocurable, heat-curable or ultrasonic-curable polymer. A backing layer 15 (FIG. 2), such as a polyethylene terephthalate film supports the curable polymer sheet or film 12.

Then exposing the film to an energy source 14 through a photomask (not illustrated) or other pattern-generating devices creates a pattern for the polishing layer. The polishing layer contains elongated sections that ultimately form channels. Stacking parallel channels provides the advantage of allowing a simple ninety degree shift between stacked layers. Advantageously, a rotation angle of 80 to 100 degrees provides sufficient support between layers. Circular, spiral, curved spiral and low-slurry channels, however, require an offset to stack the polishing layers. The energy source may be radiation, such as light or electromagnetic radiation, ultrasonic (mechanical) energy or a thermal energy. The most preferred energy source is a metal halide or xenon lamp associated to a collimation apparatus or device such as a parabolic reflector or a laser light beam. A rapid exposure to the light source cures photo curable polymers. Typically, the light exposure provides a partial cure and a heat exposure provides a final cure.

The use of a photomask or other pattern-generating device such as a computer to screen device (for instance but not limited to Stencilmaster from Signtronic, AG, Switzerland, the Screensetter from Kiwo, Inc. USA or the Xpose from Luscher, AG, Switzerland) allows the formation of multiple texture pattern combinations. For example, it is possible to produce channels that correspond to any known groove pattern, such as, parallel, X-Y coordinate, circular, spiral, curved-spiral, radial, low-slurry or a combination of patterns. The most advantageous pattern depends upon the polishing application and polishing layer required. In addition, it is possible to produce channels of varied size and macro-channels that extend through multiple layers. The channel spacing depends upon the physical properties of the pad, type polishing solution used and characteristics of the wafer being polished. For regular polishing with minimal disruption from layer to layer, the channels are advantageously parallel channels. Furthermore, through the use of registration, it is possible to produce deep channels by stacking two or more layers in registration. Also when stacking layers, it is advantageous to have odd numbered layers in registration and even numbered layers in registration. This facilitates uniform top to bottom polishing properties. When these alternate layers constitute parallel channels, it is advantageous that orthogonal relationship between the elongated channels and the elongated channels of the adjacent polymer sheets. For example, FIGS. 5 to 12 illustrate this relationship.

After curing, the exposed polymer sheet or film travels to a developing station 16 for removal of the uncured polymer. The developing station 16 may use any suitable solvent, such as water to dissolve and remove the uncured polymer. Typical examples of the developing station are an ultrasonic bath or a water jet 18 that removes water-soluble polymers. Although organic solvents are suitable for some polymers, aqueous-based solvents and water facilitate rapid dissolution of the uncured polymer. The removal of the polymer forms elongated channels that extend through the thickness of the sheet or film 12. After removing the uncured polymer, the polymer sheet or film 12 travels through drier 20 to remove excess solvent and then to collection roll 30.

Collection roll 30 contains elongated channels 32 perpendicular to the length or machine direction of the sheet or film 12. After producing the roll 30 with perpendicular channels, adjustment or rotation of the mask for radiation source exposes the next roll to energy parallel to the length or machine direction of the sheet or film 12. Then sending the sheet or film 12 through cleaning station 16 and dryer 20 produces a collection roll 34 that contains elongated channels 36. The elongated channels 36 are parallel to the length or machine direction of the sheet or film 12.

After preparing the perpendicular channel roll 30 and parallel channel roll 34, the next step is to add an open-network substrate 40 from a feed source, such as a roll. The open-network substrate 40 may have a woven or non-woven structure. Advantageously, the open-network substrate contains a pressure sensitive adhesive layer for attachment to a polishing platen. In order to provide compressibility, it is important that the open-network substrate have sufficient porosity to allow compression. This compressibility facilitates polishing warped or uneven wafers. In order to bond the perpendicular roll 30 to the open-network structure, jet 42 sprays the exposed surface of the roll 30 and the top surface of open-network substrate 40. Pinch rollers 44 followed by drier 46 bond the materials together. Then separation, rollers 48 provide for the removal of backing layer 15. For illustrative purposes, the perpendicular channel sheet or film and open-network substrate travel through optional reverse rollers 50 to flip the sheet or film. Then the parallel channel roll 34 through the use of steam jet 52 and pinch rollers 54 combine the perpendicular channels 32 (FIG. 1) with parallel channels 36 (FIG. 1). Then drier 56 secures the bond and pinch roller 58 separates the backing layer 15 from an open-network polishing pad material 60. Finally, curing open-network polishing pad material 60 in a continuous oven or as a roll in a batch oven sets the material's final properties. After this final curing open-network polishing pad material 60 cutting can produce a polishing pad of a suitable shape and size, such as a circular polishing pad.

For creating a single polishing layer the method either skips addition of parallel channel roll 34 or skips addition of parallel channel, roll 34 but adds addition rolls in registration, such as multiple perpendicular rolls 30 followed by alternating parallel roll 34. It is possible to add multiple channel rolls in registration having various channel configurations. For increasing the number of layers, it is possible to simply alternate perpendicular and parallel channels to desired number of layers. For circular, spiral, curved-spiral and low-slurry channels, it is necessary to offset the channels between rolls. For example, each, offset layer has a central axis spaced within the plane of the polishing pad to provide support for adjacent layers.

Optionally, it is possible to move the developing station 16 and drier 20 to a position after the addition of the last roll. This process allows the removal of uncured polymer in a single step. Although this process can be more efficient, developing or partially curing each roll on an individual basis can improve the uniformity and appearance of the final polishing layer. For example, partial developing or curing can reduce sagging of the sheet or film 12.

Figure 3:
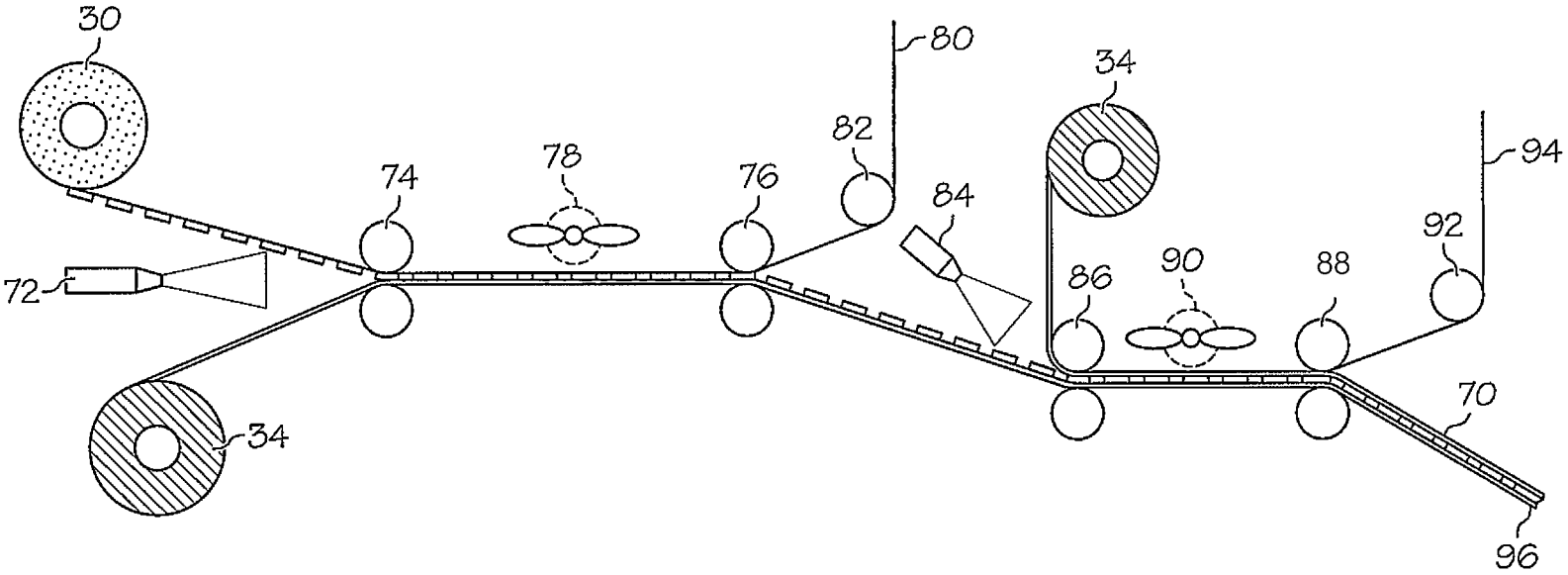
FIG. 3 is a schematic drawing that illustrates a continuous method for converting the finished feedstock into open network polishing pad material without the use of an open-network backing layer.

Referring to FIG. 3, perpendicular roll 30 may combine with one or more parallel rolls 34 to form a polishing substrate 70 absent an open-network substrate. In this process, steam combines perpendicular roll 30 with a first parallel roll 34 through the use of pincher rolls 74 and 76 and drier 78. After drying, the method separates a first backing layer 80 using side roller 82. After removing the backing layer 80, the substrate travels to second parallel roll 34 where rollers 86 and 88 with drier 90 secure the perpendicular roll 34 to the substrate with the bars alternating at 90 degrees. After the drying, side roller 92 removes second backing layer 94. The final polishing substrate 70 includes the third backing layer 96 for support. After cutting the polishing substrate 70 to size, it is possible to remove the backing layer 96 to secure the polishing substrate 70 to a polishing platen (not shown) or to leave the backing layer 96 and secure the backing layer 96 to the polishing platen.

Figure 4:
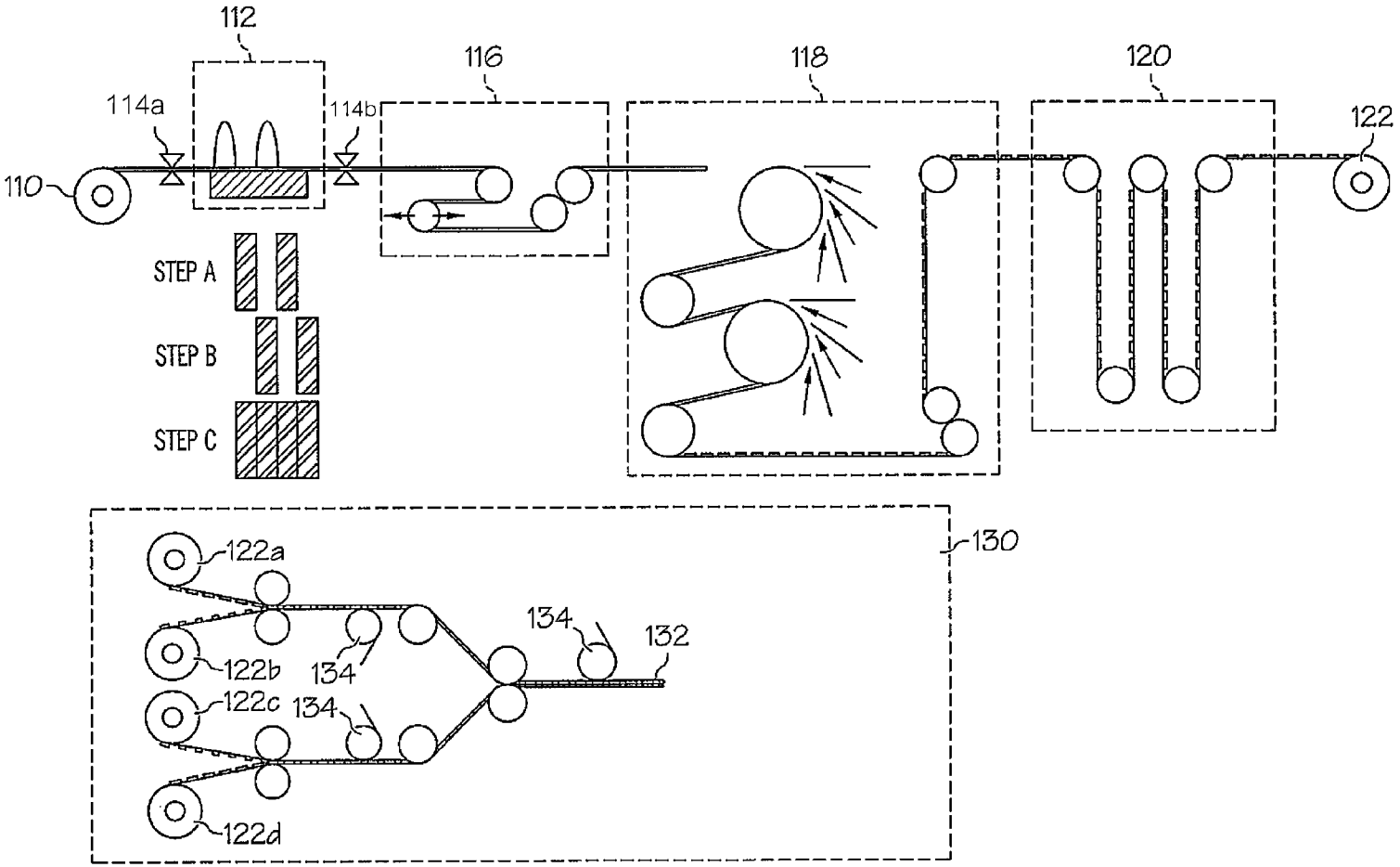
FIG. 4 is a schematic drawing illustrating registered imaging of a photocurable polymer and an assembling unit for combining four developed layers.

Referring to FIG. 4, a roll of photocurable film 110 travels through imaging unit 112 with the use of registered step film transfer units 114*a* and 114*b*. The imaging unit 112 exposes two spaced regions at a forty-five degree angle with step A. These two units expose one-half of a unit length. After step A, the photocurable film 110 travels a one quarter length distance in step B with the use of the step film transfer units 114*a* and 114*b*. Then in step C, the imaging unit exposes the remaining half of the unit length. After step C, the photocurable film 110 travels one full unit length to prepare for repeated three step processes. Buffer rollers 116 adjust the overall speed of the photocurable film 110 to a constant rate. Then the film 110 travels through developing unit 118 where water jets remove unexposed polymer. Finally the drying unit 120 cures the polymer film 110 and roll 122 collects the cured polymer film.

In assembly unit 130, four rolls of cured film 122*a*, 122*b*, 122*c* and 122*d* combine to form a polishing substrate 132. This unit secures the cured films 122*a*, 122*b*, 122*c* and 122*d* and removes all but one of the backing layers 134 using a series of rollers and an adhesive, such as water or glue. After the assembly unit 130, the film is cut to size for use in a polishing operation.

When stacking above two layers, advantageously the odd and even numbered stacked layers are in registration, respectively. The registration method is based on punching the photocurable film and using a ruler with pins to align the film relative to each other. The first and third (and subsequent odd) are punched with the same orientation with the same puncher insuring a fixed relative position of the punched holes. The second and fourth layer (and subsequent even) are also punched similarly, but in a 90 degree rotated orientation. Next, each pair of photocurable polymer is exposed using a photomask also punched on the pin ruler so each exposure is done with the same relative position of the line pattern. The result is a good replication of the pattern with a good registration of the lines between every other film. Even layers are also processed using the same method with a pin ruler and a mask oriented at 90 degrees. Finally, the ruler is again used for the assembling to keep the relative position of the line pattern fixed from one layer to the other.

EXAMPLES

A series of thirteen examples illustrates the method of converting photocurable sheet or film into a useful polishing material. A series of ten examples illustrate the manufacturing flexibility achieved with the process of the invention. Table 1 summarizes the Examples as follows:

TABLE 1

| Example | Substrate | Substrate/Layer No. 1 Adhesion Method | Interlayers Adhesion Method | Layers | Material Product Name |
|---|---|---|---|---|---|
| 1 | Woven | water spraying | Water spraying | 4 | CDF QT50 |
| 2 | Woven | photosensitive QLT emulsion | Water Immersion | 4 | Razor 50 |

TABLE 1-continued

| Example | Substrate | Substrate/Layer No. 1 Adhesion Method | Interlayers Adhesion Method | Layers | Material Product Name |
|---|---|---|---|---|---|
| 3 | Woven | water | Water | 4 | Thik 100 |
| 4 | Woven | photosensitive QLT emulsion | Steam | 4 | CDF QT100 |
| 5 | Woven | photosensitive QLT emulsion | Ulano Hardener (spray gun or bottle) | 4 | CDF QT100 |
| 6 | Woven | photosensitive QLT emulsion | Photosensitive QLT Emulsion | 2 | CDF QT50 |
| 7 | Non-Woven | Elmer's glue | Elmer's glue | 2 | MS100 |
| 8 | Non-Woven | Photosensitive QLT emulsion | QLT emulsion | 1 | CDF QT100 |
| 9 | Non-Woven | Elmer's glue | Ulano Hardener D (Spray Gun or Bottle) | 4 | Magnacure 70 |
| 10 | Non-Woven | Elmer's glue | AB Hardener (Spray Bottle) | 2 | MS100 |
| 11 | None | None | AB Hardener (Spray Bottle) | 2 | Topaz 50 |
| 12 | None | None | Heated | 3 | CDF QT100 |
| 13 | None | None | Steam | 2 | CDF QT100 |

The materials tested used exposure times as listed in Table 2 as follows:

TABLE 2

| Manufacturer | Product | Free Cap Exposure (s) | Polymer* | Layer 1 Exposure with Ulano Emulsion (s) | Layer 2 exposure (s) |
|---|---|---|---|---|---|
| Ulano | CDF QT50 | 45 | Poly(3-hydroxybutyrate) Poly(vinyl alcohol) | 75 | 45 |
| Ulano | CDF QT100 | 60 | Poly(3-hydroxybutyrate) Poly(vinyl alcohol) | 125 | 60 |
| Chromaline | Magnacure 70 | 175 | Poly(propyleneglycol) Poly(vinyl alcohol) | 250 | NA |
| Murakami | MS100 | 160 | Poly(vinyl alcohol) | NA | NA |
| Fotec | Topaz 50 | 270 | Poly(vinyl alcohol) | 350 | NA |
| SAATI | Thik 100 | 45 | NA | 125 | 75 |

Polymer = Major Polymer in formulation

NA = Not Available

Example 1

Figure 5:
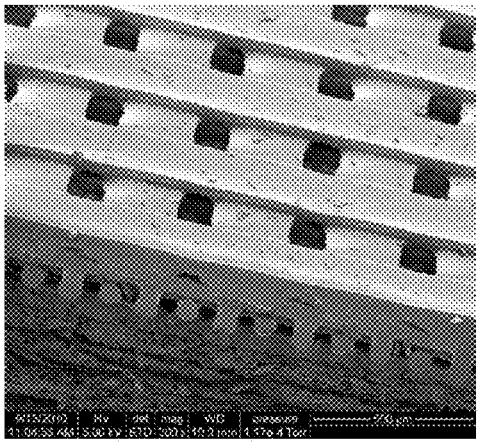
FIG. 5 is an SEM of an open-network polishing pad formed on a woven substrate manufactured in accordance with Example 1.

This Example relates to forming an open-network pad through the use of an open network substrate and a photocurable film. First, stretching a woven polyester fiber 205 mesh (75.5 μm) substrate over an aluminum frame at 20 N/m removes any wrinkles from the substrate. Advantageously, a commercial screen printing degreaser washes and degreases the polyester substrate to remove any dirt or stains. This is important because dirt and stains can prevent good contact between the photocurable film and the woven substrate's polyester fibers. The woven substrate was then wet with clean water with sufficient incline to let excess water run down. Then Ulano photocurable film CDF QT50, as delivered attached to its Mylar polyethylene terephthalate protective sheet, was then rolled out with the unprotected side of the photocurable film towards the exterior. The roll was applied on top of the woven substrate and then unrolled downwards with application of some moderate pressure. This pressure, in combination with the wet surface of the woven substrate, secures the components with a temporary bond. This temporary bond forms an assembly having sufficient "green strength" to secure the components during transportation. The assembly was dried at 35° C. for an hour in air to allow for the protective Mylar PET film to be peeled away. The photocurable film surface opposite to the woven mesh was then brought in contact with a photomask that is a clear Mylar sheet with opaque markings and was exposed to a light source. The exposure times listed in Table 2 were sufficient to cure the film. The ultraviolet light source was a metal halide lamp of an MSP 3140 UV exposure unit from Nuarc for 45 seconds through a photomask fabricated by Infinite Graphics with a line pattern of specific graphic design, such as pitch and space. The layer was then developed using an electric pressure washer with a nominal pressure of 1500 psi (10.3 MPa) fed with tap water. Most advantageously, the cleaning was realized with deionized and filtered water. The assembly was then thoroughly dried at 35° C. for one hour. Subsequent layers were built in the same fashion in multiple steps. 1) The photocurable film was immersed in tap water for 10 seconds for uniform water coverage and immediately laminated on the line pattern surface. Most advantageously, the immersion was into deionized and filtered water. 2) The assembly was dried for an hour at 35° C. to secure the stacked components. 3) After drying and securing the stacked components, imaging and developing secured the multiple layers. The imaging step rotated the elongated sections ninety degrees to ensure support between multiple sections. 4) After adding the second layer, drying for an hour at 35° C. provided a partial cure or develop to reduce sagging. The partial cure or develop formed a stable foundation for the buildup of the next layer as a dry foundation would stick better to a freshly wet additional layer applied onto it. FIG. 5 illustrates the final product of an open-network mounted on a woven substrate.

Example 2

Figure 6:
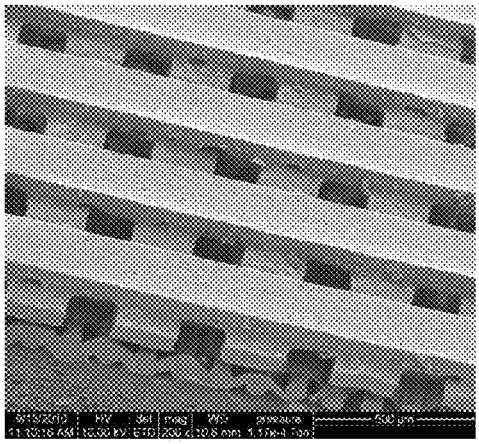
FIG. 6 is an SEM of an open-network polishing pad formed on a woven substrate manufactured in accordance with Example 2.

This Example relates to forming an open-network pad through the use of adhesive to form an open network substrate. In particular, the method builds up a structured pad by gluing the photocurable polymer film to a woven mesh substrate. A woven polyester fiber 305 mesh (56.6 μm) stretched on an aluminum frame between 15 and 20 N/m removed any wrinkles from the substrate. A commercial screen printing degreaser washed and degreased the polyester substrate to remove dirt and stains. This cleaning step facilitated contact and subsequent adhesion between the woven mesh and the photocurable film. An Ulano CDF QT50 photocurable film (about 60 μm thick) was then placed on top of the woven substrate with edges taped to the polyester woven substrate or to the aluminum frame. A precaution was to tape the rest of the woven substrate to avoid spillage from the next step. The next step was to apply some photoemulsion to one side of the mesh. The photoemulsion puddle was then squeegeed from top to bottom. The photoemulsion was a photosensitive Ulano QLT with some additional diazo sensitizer for more rapid crosslinking under irradiation. Drawn down by the squeegee, the emulsion filled the pores of the polyester woven substrate and contacted the photocurable films taped to the other photocurable film. The assembly was left to dry for an hour at 35° C. The protective polyethylene terephthalate sheet of the photocurable polymer film was then peeled away. The assembly was then exposed using exposure times as outlined in Table 2 and explained in Example No. 1 for 50 seconds and then developed and dried in a similar fashion. The unexposed photoemulsion was washed away by the action of the water and the crosslinked photoemulsion left on the woven substrate locked the photocured film against the woven substrate. FIG. 6 illustrates the final product of an open-network mounted on a woven substrate.

Example 3

The preparation of the base layer using SaatiChem Thik Film photocurable film of about 100 μm thick was realized as described in Example No. 2 with an exposure time of 120 seconds. The addition of subsequent layers of the photocurable film was done through multiple steps. First, the lamination of the second photocurable film layer required wetting the interface between the photocurable film and the second layer. The most important aspect was to achieve uniform water absorption at the surface of the second photocurable film.

Water spraying did not provide good enough results, but complete immersion of the photocurable film for an 8 to 10 seconds period in water provided uniform wetting and sufficient absorption for a uniform adhesion of the second photocurable layer. After this wet lamination, the assembly (woven mesh on frame plus two layers) was dried for an hour at 35° C. The protective Mylar polyethylene terephthalate sheet of the second layer was then peeled off and the layer was exposed using exposure times as outlined in Table 2 to UV irradiation through the mask rotated 90 degrees angle as referenced to the first layer. The second photocurable polymer film was then developed with a pressure washer like the first layer and left to dry at 35° C. for an hour.

Example 4

The preparation of the base layer using Ulano CDF QT100 photocurable film of about 110 μm thick was realized as described in Example No. 2. The addition of subsequent layers of Ulano CDF QT100 photocurable polymer film was performed in multiple steps. 1) A second photocurable polymer film was laid down on the glass plate of the Nuarc MSP 3140 UV exposure unit with the photocurable side face up and the protective Mylar polyethylene terephthalate sheet down. 2) Next, the base layer was attached to the polyester woven mesh was placed above the photocurable polymer film in the Nuarc UV exposure unit and held up by a large spacer. Both sides of this assembly were then sprayed with steam using a commercial water vapor cleaner for 50 seconds and were laminated together. The assembly disposition allowed bringing the two elements together and applying a uniform pressure between the two layers by means of a vacuum rubber membrane of the exposure unit for 60 seconds. 3) The vacuum was then broken and the assembly was removed from the instrument and dried for an hour at 35° C. 4) The second layer was then exposed using exposure times as outlined in Table 2 and developed and dried as in Example No. 3. 5) The subsequent layers were laminated by repeating the steps used for the second layer.

Example 5

Figure 7:
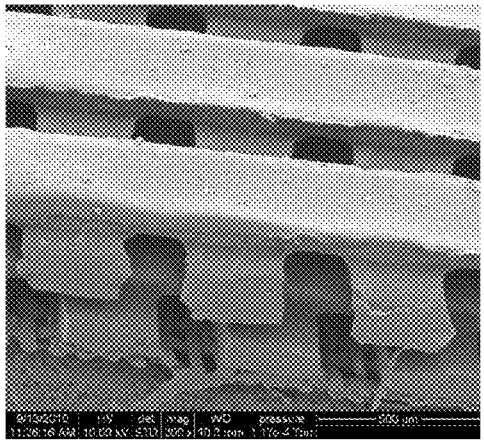
FIG. 7 is an SEM of an open-network polishing pad formed on a woven substrate manufactured in accordance with Example 5.

The preparation of the base layer using Ulano CDF QT100 photocurable polymer film of about 110 μm thick was realized as described in Example No. 2. The addition of subsequent layers of Ulano CDF QT100 photocurable polymer film was performed as follows. A second photocurable polymer film was exposed using exposure times specified in Table 2 through a photomask and developed with its protective sheet. The resulting patterned photocurable polymer film was laid down on a flat table top with the photocurable polymer face up and the protective Mylar polyethylene terephthalate sheet down. Next the base layer attached to the polyester woven substrate was placed next to the second layer with the photocurable film face up. Both sides of this assembly were then sprayed with Ulano hardener D photocurable film hardener. The two elements were then laminated together in the vacuum membrane system of the Nuarc exposure unit for the application of a uniform pressure between the two layers with a vacuum rubber membrane of the exposure unit for 60 seconds. The vacuum was then broken and the assembly was removed from the instrument and dried for an hour at 35° C. The subsequent layers were prepared and laminated by repeating the steps described above for the second layer. FIG. 7 illustrates the final product of an open-network mounted on a woven substrate.

Example 6

The preparation of the base layer using Ulano CDF QT50 photocurable film of about 60 microns thick was realized as described in Example No. 2 using the exposure times specified in Table No. 2. The addition of subsequent layers of Ulano CDF QT50 photocurable film was performed with modified steps. 1) A photocurable film was laid down flat and a thin film of photocurable Ulano QTX photoemulsion was deposited using a woven polyester fiber 200 mesh (74 μm) under tension in an aluminum frame. 2) Photoemulsion was squeegeed through the mesh and the plain photocurable polymer film was laminated using slight pressure provided by a rubber roller. Moderate pressure between the photocurable polymer and the liquid photomulsion provided intimate contact, but too high pressure could result in large amount of photoemulsion squeezed out from the contact zone between bars and surface. Thus, this process used a reduce pressure. 3) The assembly was then dried for an hour at 35° C., exposed using exposure times as outlined in Table 2, developed and dried as described in Example No. 1. 4) Subsequent layers were laminated by repeating the steps used for the second layer.

Example 7

Figure 8:
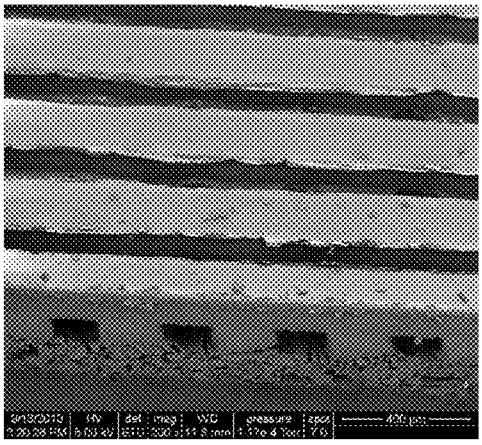
FIG. 8 is an SEM of an open-network polishing pad formed on a non-woven substrate manufactured in accordance with Example 7.

The base layer of this example was a CU 632 UF non-woven polyester sheet material from Crane and Co., Inc. Dalton, Mass. Elmer's® multi-purpose glue was applied on the surface of the non-woven fibrous material using a screen printing frame with a polyester woven fiber of 200 mesh (74 μm). The aluminum frame placed on top of the non-woven sheet and liquid Elmer's® glue dispensed at the top of the mesh area. A squeegee then pushed the glue through the pores of the mesh and the frame was removed from the surface. On the resulting thin layer of glue, the photocurable polymer face of an exposed using exposure times as outlined in Table 2 and developed Murakami (Japan) photo photocurable polymer film MS100 was gently pressed down. The assembly was left drying for an hour at 35° C. and the protective sheet of the MS100 was peeled away. The second layer was glued to the first one using the same deposition method of Elmer's multi-purpose glue. FIG. 8 illustrates the final product of an open-network mounted on a non-woven substrate.

Example 8

Figure 9:
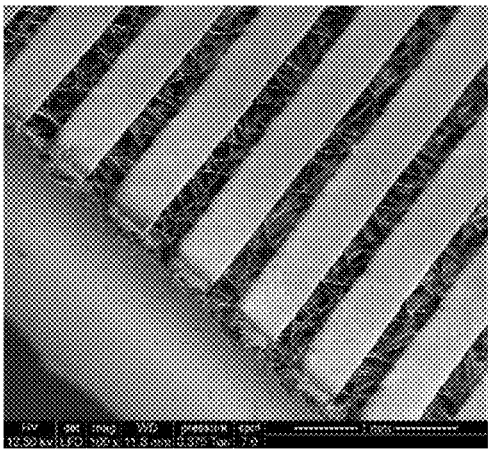
FIG. 9 is an SEM of an open-network polishing pad formed on a non-woven substrate manufactured in accordance with Example 8.

Photocurable film Ulano CDF QT 100 of about 100 μm thickness was exposed using exposure times as outlined in Table 2 through a photomask and then developed with an electric power washer using tap water and dried in a drying cabinet at 35° C. for one hour in air. Photoemulsion Ulano QLT photoemulsion was deposited on the surface of the line pattern thus created using a 200 mesh (74 micron) woven fiber and a squeegee. The screen was applied flat on the film surface and pressed down as the photoemulsion was pushed through the woven substrate. The photocurable film was then pressed on the polyester non-woven mesh made by Pellon, Saint Petersburg, Fla. The rapid drying of the photoemulsion required a fast lamination of the photocurable film on the mesh. Then the assembly was left to dry for an hour at 35° C. The protective Mylar polyethylene terephthalate backing sheet of the Ulano photocurable film was peeled away. FIG. 9 illustrates the final product of an open-network mounted on a non-woven substrate.

Example 9

The photocurable film was Chromaline Magnacure 70® of about 80 μm in thickness. Individual layers were imaged and developed as described in example No. 2 using exposure times as outlined in Table 2. The first layer was attached to the base using the same method as described in Example No. 7. The second layer and up were assembled using the Ulano hardener D® as described in Example No. 5.

Example 10

The photocurable film was Murakami (Japan) MS100® of 100 μm in thickness exposed using exposure times as outlined in Table 2. The first layer was attached to the base using the same method as described in Example No. 7. The second layer and up are assembled using the Murakami hardener AB® as described in Example No. 5.

Example 11

Two Fotec Topaz 50 photocurable polymer films were exposed using exposure times as outlined in Table 2 through a photomask and developed with its protective sheet secured to its underside. The resulting patterned photocurable film was laid down on a flat table top with the exposed film face up and the protective Mylar polyethylene terephthalate sheet down.

Figure 10:
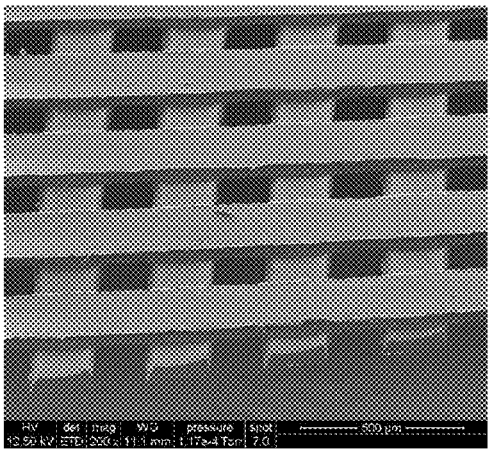
FIG. 10 is an SEM of an open-network polishing pad formed without a base substrate manufactured in accordance with Example 11.

Both sides of this assembly were then sprayed with Ulano hardener D, a commercial polymeric film hardener. The two elements were then laminated together in a vacuum membrane system of the Nuarc exposure unit for the application of a uniform pressure between the two layers with a vacuum rubber membrane set to an exposure time of 60 seconds. The vacuum was then broken and the assembly was removed from the instrument and dried for an hour at 35° C. The subsequent layers were prepared and laminated by repeating the steps described above for the second layer. FIG. 10 illustrates the final product of an open-network attached without the use of a base substrate.

Example 12

Figure 11:
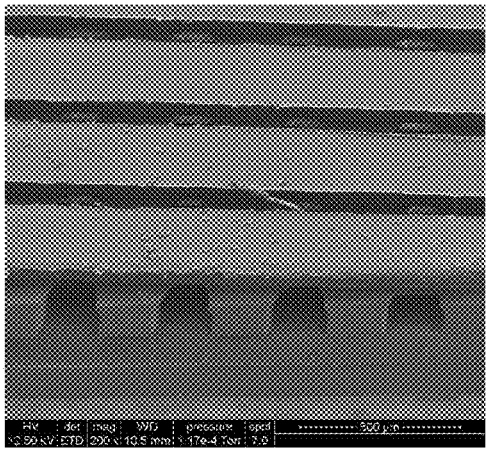
FIG. 11 is an SEM of an open-network polishing pad formed with a solid base substrate manufactured in accordance with Example 12.

Photocurable Ulano CDF QT 100 film was exposed using exposure times as outlined in Table 2 and developed on their backing and dried at 35° C. for an hour. The two elements were then laminated together in a vacuum membrane system of the Nuarc exposure unit for the application of a uniform pressure between the two layers with a vacuum rubber membrane set to an exposure time of 270 seconds. The vacuum was then broken and the assembly was removed from the instrument. The sandwich structure was placed between a glass plates and the whole assembly was held together using paper clips and left in an oven at 95° C. for about 16 hours. The resulting double layer structure could be then peeled away from the Mylar polyethylene terephthalate protective backing. FIG. 11 illustrates the final product of an open-network attached to a solid base substrate.

Example 13

Figure 12:
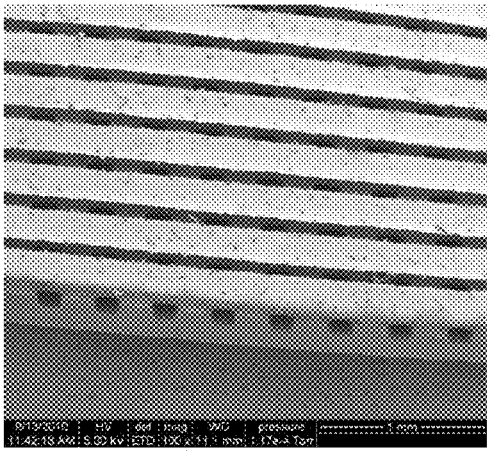
FIG. 12 is an SEM of an open-network polishing pad formed without a base substrate manufactured in accordance with Example 13.

Free standing photocurable films have been imaged using exposure times as outlined in Table 2 and developed on their protective polyethylene terephthalate Mylar sheet using the exposure unit and the photomask of Example 12. Each layer was then exposed to steam using a commercial steamer Deluxe Portable Steam Pocket SC650 Shark for 50 seconds on each layer. The photocurable films were then gently pressed together and left to dry at 35° C. in a drying cabinet overnight. The protective Mylar polyethylene terephthalate sheets were then peeled away from one side. Additional layers may be added by repeating the steaming steps with photocurable film using exposure times as outlined in Table 2 and developed layers. FIG. 12 illustrates the final product of an open-network attached without the use of a base substrate.

The invention claimed is:

1. A method of forming a layered-open-network polishing pad useful for polishing at least one of magnetic, semiconductor and optical substrates comprising:

a) providing a first and second polymer sheet or film of a photocurable polymer, the first and second polymer sheet or film having a thickness;

b) exposing the first and second polymer sheets or films to a collimated light energy source to create an exposure pattern in the first and second polymer sheet or film with light exposure, the exposure pattern having elongated sections exposed to the collimated light energy source, the light exposure being of an exposure time sufficient to cure the photocurable polymer, the exposure time being insufficient to cure adjacent elongated sections together;

c) removing polymer from the exposed first and second polymer sheets or films adjacent the exposure pattern to form elongated channels through the first and second polymer sheets or films in a channel pattern that corresponds to the exposure pattern, the elongated channels extending through the thickness of the first and second polymer;

d) attaching the first and second polymer sheets or films to form a polishing pad, the patterns of the first and second polymer sheets or films crossing wherein the first polymer sheet or film supports the second polymer sheet or film and the elongated channels from the first and second polymer sheets or films connect in parallel planes to form the layered-open-network polishing pad with one of the polymer sheets or films forming a polishing surface; and e) curing the layered-open-network polishing pad to secure the layered-open-network polishing pad with the first and second sheets or films having sufficient stiffness to reduce sagging and maintain an orthogonal relationship between the elongated channels and the parallel planes of the polymer sheets or films and the layered-open-network pad having perpendicular channel side walls and horizontal top and bottom surfaces.

2. The method of claim 1 wherein the elongated channels of adjacent parallel planes are attached in, an orthogonal relationship.

3. The method of claim 1 wherein the exposing the first and second sheets or films to the collimated light energy source includes collimated light sent through a photomask or sent in a direct pattern to form the exposure pattern with either curved or linear elongated channels.

4. The method of claim 3 wherein the exposing forms the exposure pattern with the exposure pattern having parallel channels.

5. The method of claim 1 including a partial curing step of the first and second polymer sheet or film before attaching the first and second polymer sheet or film.

6. A method of forming a layered-open-network polishing pad useful for polishing at least one of magnetic, semiconductor and optical substrates comprising:

a) providing a first and second polymer sheet or film of a photocurable polymer, the first and second polymer sheet or film having a thickness;

b) exposing the first and second polymer sheets or films to a collimated light energy source to create an exposure pattern in the first and second polymer sheet or film with light exposure, the exposure pattern having elongated sections exposed to the collimated light energy source, the light exposure being of an exposure time sufficient to cross-link the photocurable polymer, the exposure time being insufficient to cross-link adjacent elongated sections together;

c) removing polymer from the exposed first and second polymer sheets or films adjacent the exposure pattern with an aqueous solution to form elongated channels through the first and second polymer sheets or films in a channel pattern that corresponds to the exposure pattern, the elongated channels extending through the thickness of the first and second polymer;

d) drying the first and second sheets or films to remove the aqueous solution and provide a partial cure for the first and second sheets or films;

e) attaching the first and second polymer sheets or films to form a polishing pad, the patterns of the first and second polymer sheets or films crossing wherein the first polymer sheet or film supports the second polymer sheet or film and the elongated channels from the first and second polymer sheets or films connect in parallel planes to form the layered-open-network polishing pad with one of the polymer sheets or films forming a polishing surface and the layered-open-network pad having perpendicular channel side walls and horizontal top and bottom surfaces; and f) curing the layered-open-network polishing pad to secure the layered-open-network polishing pad with the first and second sheets or films having sufficient stiffness to reduce sagging and maintain an orthogonal relationship between the elongated channels and the parallel planes of the polymer sheets or films, the orthogonal relationship being an angle between 80 and 100 degrees.

7. The method of claim 6 wherein the elongated channels of adjacent parallel planes are attached in an orthogonal relationship.

8. The method of claim 6 wherein the exposing the first and second sheets or films to the collimated light energy source includes collimated light sent through a photomask or sent in a direct pattern to form the exposure pattern with either curved or linear elongated channels.

9. The method of claim 8 wherein the exposing forms the exposure pattern with the exposure pattern having parallel channels.

10. The method of claim 6 including the partial curing step of the first and second polymer sheet or film before attaching the first and second polymer sheet or film.

* * * * *